United States Patent [19]

Konther et al.

[11] 4,318,370

[45] Mar. 9, 1982

[54] ROTARY INTERNAL COMBUSTION ENGINES

[76] Inventors: Siegfried Konther, Rua Azara; Sigfrido K. Chamorro, Rua Cerro Cora; Udi K. Chamorro, Azara Y Cerro Cora, all of San Lorenzo, Paraguay

[21] Appl. No.: 92,404

[22] Filed: Nov. 8, 1979

Related U.S. Application Data

[63] Continuation-in-part of Ser. No. 808,419, Jun. 20, 1977, Pat. No. 4,178,885.

[51] Int. Cl.[3] ..... F02B 57/06

[52] U.S. Cl. ..... 123/44 C; 123/26

[58] Field of Search ..... 123/43 R, 44 R, 44 C, 123/26, 433

[56] References Cited

U.S. PATENT DOCUMENTS

| | | | |
|---|---|---|---|
| 890,532 | 6/1908 | Schmucker | 123/44 C |
| 998,284 | 7/1911 | Ebersole | 123/44 C |
| 1,200,519 | 10/1916 | Peterson | 123/26 X |
| 1,236,275 | 8/1917 | Dickson | 123/44 C |
| 1,299,662 | 4/1919 | Beggs | 123/44 C |
| 1,980,924 | 11/1934 | McDonald | 123/44 C |
| 3,851,630 | 12/1974 | Foster | 123/44 C X |
| 3,931,809 | 1/1976 | Corte et al. | 123/44 C X |

FOREIGN PATENT DOCUMENTS 263310 8/1913 Fed. Rep. of Germany .... 123/44 C

*Primary Examiner*—Michael Koczo, Jr.
*Attorney, Agent, or Firm*—Ladas & Parry

[57] ABSTRACT

A rotary internal combustion engine comprises a rotor assembly which is mounted to rotate about an axis of rotation and comprises a double-headed piston member having two primary pistons at opposite ends respectively of an intermediate portion of the piston member and also having two secondary pistons at opposite ends respectively of the intermediate portion, and a double-headed cylinder member defining two primary cylinders in which the two primary pistons are fitted respectively and also defining two secondary cylinders in which the two secondary pistons are fitted respectively. One of the members is mounted to rotate about the axis of rotation of the rotor assembly, while the other member rotates about a crank axis which is offset from the axis of rotation of the rotor assembly. Thus, the pistons reciprocate relative to the cylinders as the rotor assembly rotates. The spaces in the primary cylinders constitute combustion chambers and the spaces in the secondary cylinders constitute pumping chambers which are connected to inject air into the combustion chambers during combustion of fuel therein.

11 Claims, 2 Drawing Figures

ROTARY INTERNAL COMBUSTION ENGINES

This is a continuation-in-part of Application Ser. No. 808,419 filed June 20, 1977, now U.S. Pat. No. 4,178,885, granted Dec. 18, 1979.

According to the present invention there is provided a rotary internal combustion engine comprising:

support means defining an axis of rotation and provided with static crankshaft means defining a crank axis which is offset from said axis of rotation;

a rotor assembly which is mounted by said support means to rotate about said axis of rotation and comprises a double-headed piston member having two primary pistons at opposite ends respectively of an intermediate portion of the piston member and also having two secondary pistons at opposite ends respectively of said intermediate portion, and a double-headed cylinder member defining two primary cylinders in which the two primary pistons are fitted respectively and also defining two secondary cylinders in which the two secondary pistons are fitted respectively, one of said members being connected to said crankshaft means to rotate about the crank axis defined thereby and the other being rotatable about said axis of rotation, whereby each piston reciprocates relative to the cylinder in which it is fitted as the rotor assembly rotates about said axis of rotation, the spaces in the primary cylinders which are bounded by the primary pistons fitted respectively therein constituting combustion chambers and the spaces in the secondary cylinders which are bounded by the secondary pistons fitted respectively therein constituting pumping chambers;

means defining a fuel inlet;

first passage means establishing communication between the fuel inlet and the two combustion chambers, said first passage means including passages formed in the cylinder member and controlled by edge regions of the piston member;

means defining an air inlet; and second passage means establishing communication between the air inlet and the two pumping chambers and between the two pumping chambers and the combustion chambers respectively, said second passage means including passages formed in the cylinder member and controlled by edge regions of the piston member.

Figure 1:
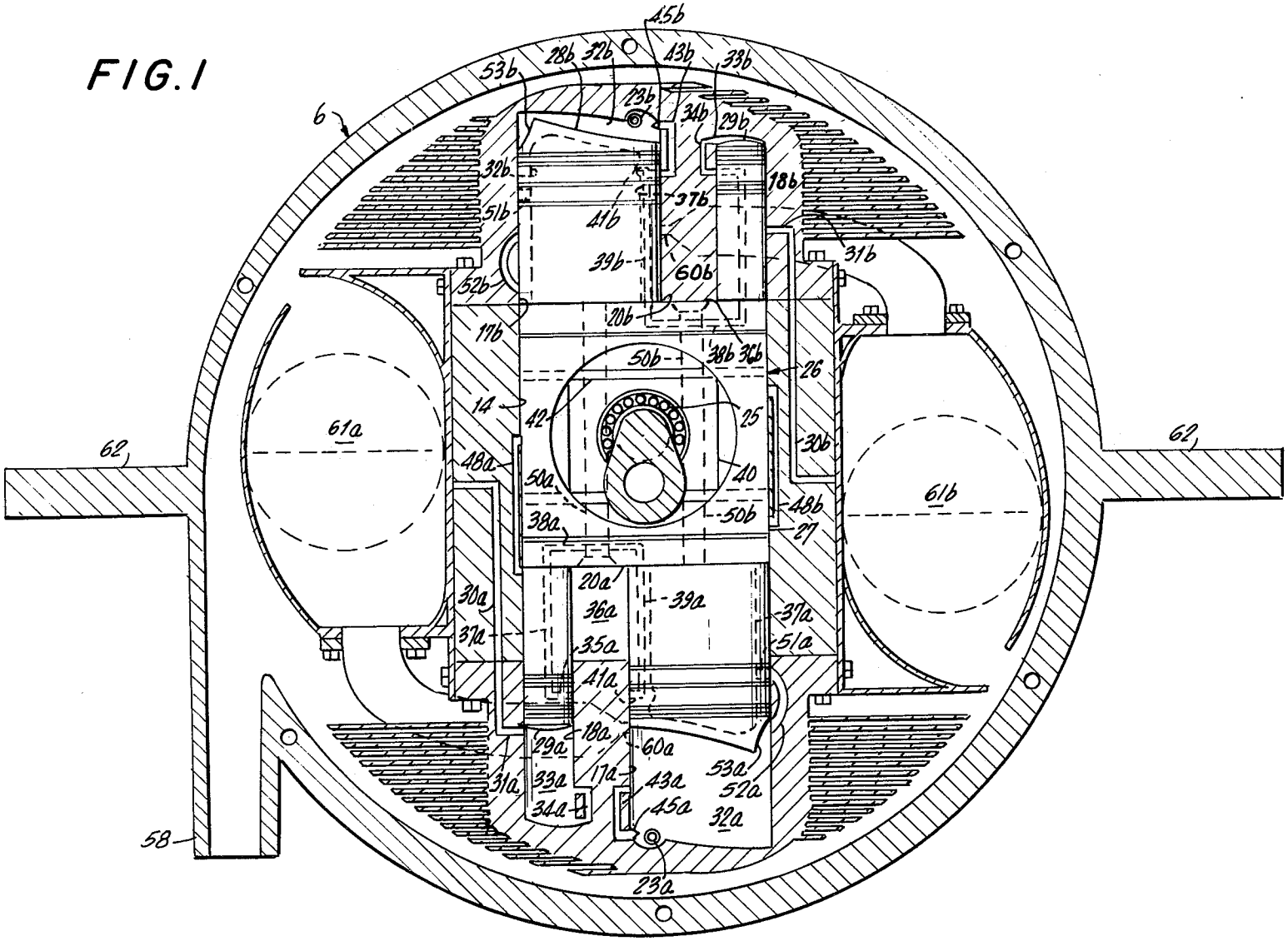
Figure 2:
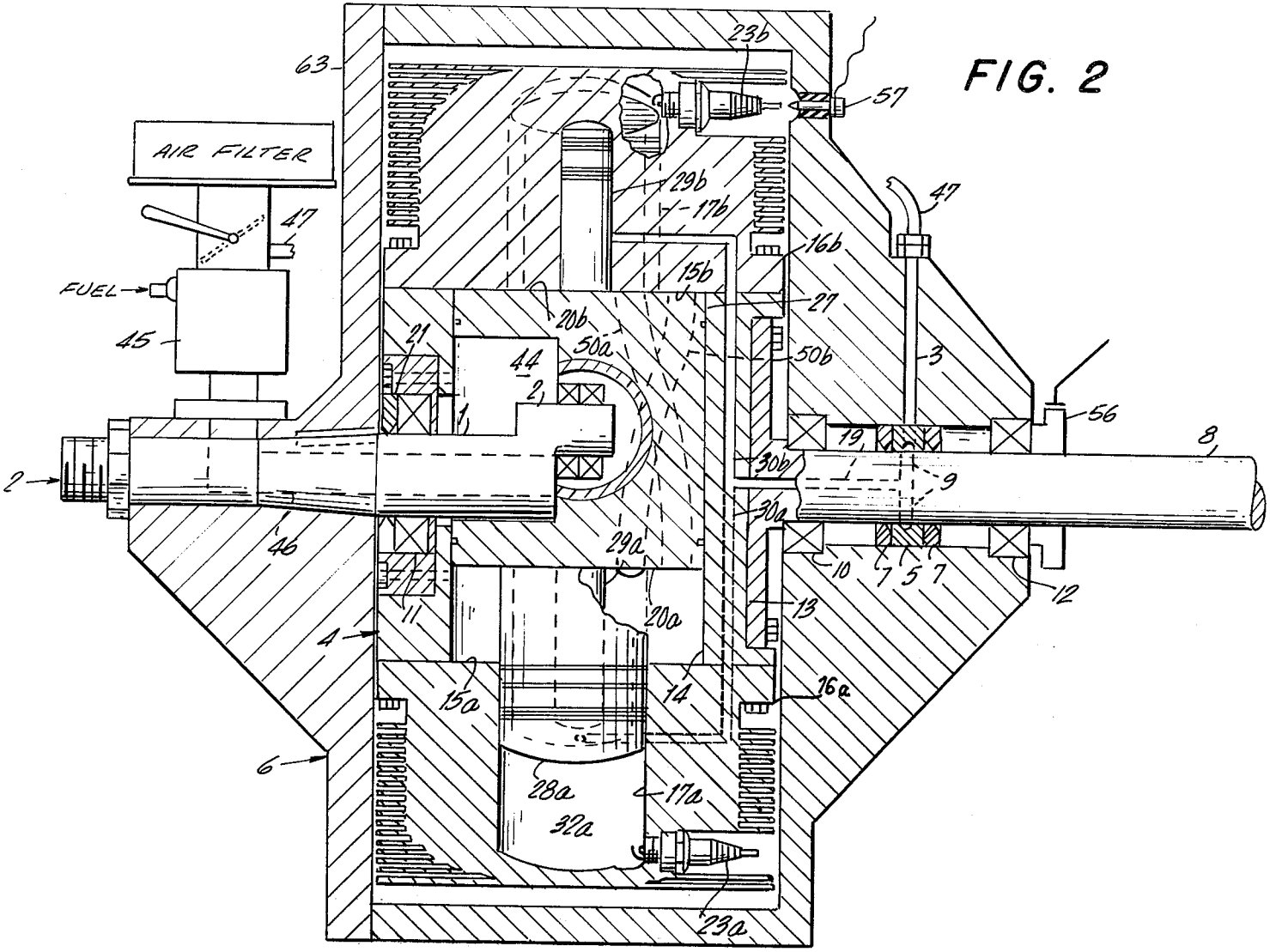

For a better understanding of the invention, and to show how the same may be carried into effect, reference will now be made, by way of example, to the accompanying drawings in which:

FIG. 1 shows a schematic view, partly in section and partly in elevation, of a rotary engine embodying the present invention; and FIG. 2 shows a schematic view of the engine of FIG. 1, partly in elevation and partly in section, viewed in a direction perpendicular to the viewing direction of FIG. 1.

The illustrated engine comprises a housing 6 supported by means of lateral flanges 62 and to which is mounted a stationary crankshaft 2 having a main bearing journal pin 1 and a free crank pin 24. Axially aligned with the journal pin 1 is a driven shaft 8 which is rotatably supported in the housing 6 by main bearings 10 and 12. A rotor 4 which is positioned within the housing 6 is flange-connected to the shaft 8 and is mounted to rotate about the pin 1 on a bearing 11. The rotor 4 comprises a cylinder member 13 having a central cylinder barrel

14 and two further double-barrel cylinder members **16*a* and 16*b* which are bolted to opposite ends of the member 13. The members 16*a* and 16*b* have respective inner faces 15*a* and 15*b*. The walls of the members 16 are provided on the outside with cooling fins. The cylinder members 16*a* and 16*b* define respective larger cylinders 17*a* and 17*b* and also define respective smaller cylinders 18*a* and 18*b*. A double-ended piston member 26, shown partly in elevation, has a central portion 27 which is disposed in the barrel 14 and has two opposite end faces 20*a* and 20*b* from which project two working end pistons 28*a* and 28*b* disposed in the cylinders 17*a* and 17*b* respectively and two auxiliary end pistons 29*a* and 29*b* disposed in the cylinders 18*a* and 18*b* respectively. The pistons 28*a* and 28*b* cooperate with the larger cylinders 17*a* and 17*b* to form two cylindrical combustion chambers 32*a* and 32*b*, while the pistons 29*a* and 29*b* cooperate with the cylinders 18*a* and 18*b* to form two cylindrical pumping chambers 33*a* and 33*b*. The end faces 20*a* and 20*b* of the portion 28 cooperate with the inner faces 15*a* and 15*b* respectively of the cylinder members 16*a* and 16*b* and with the peripheral walls of the pistons 28*a*, 28*b*, 29*a* and 29*b* and the inner wall of the member 13 to define two precompression chambers 36*a* and 36*b*. Spark plugs 23*a* and 23*b* project in conventional manner into the combustion chambers 32*a* and 32*b*** adjacent to the closed ends thereof.

With each stroke of the piston member 26 in the cylinder member 13, one of the combustion chambers 32, one of the pumping chambers 33 and one of the precompression chambers 36 are simultaneously compressed, while the other combustion chamber, pumping chamber and precompression chamber are compressed on the next stroke. The stroke of the piston member 26 within cylinder member 13 is equal to twice the eccentricity of the crankshaft 2.

A cross-head or carriage 40 is mounted to rotate about the free crank pin 24 on a roller bearing 25. The carriage 40 is of cylindrical shape and is capable of reciprocating perpendicularly with respect to the axis of the piston member 26 within a bronze slide sleeve 42 arranged in the piston member 26, as particularly shown in FIG. 1. The stroke of the carriage 40 within the sleeve 42 must be at least as large as the stroke of piston member 26.

The piston member 26 is formed with a crank space 44 in order to permit the piston member to rotate freely about the pin 24 without obstruction by the crank web. The crank space 44 communicates with a carburetor 45 by way of axial conduit 46 provided in the main bearing journal pin 1.

The illustrated engine is a two-stroke engine, and in accordance with conventional practice the fuel that is fed into the crank space 44 contains a small proportion of oil which lubricates the bearings 11 and 25, and also lubricates movement of the carriage 40 in the sleeve 42. Escape of fuel from the crank space 44 into the housing 6 is prevented by a seal 21. The fuel may comprise a mixture of naphtha and oil.

The feeding of fuel to the combustion chambers by way of the conduit 46 is described in the following.

Fuel mixture is fed from the crank space 44 by way of a passage **48*a* or 48*b* formed in the wall of the barrel 14 into the precompression chamber 36*a* or 36*b*. FIG. 1 shows the piston member 26 in a position in which the passage 48*a* is in communication with the precompression chamber 36*a*. The passages 48** are controlled in known manner by the edges of the central piston portion 27, so that each time one of the pistons 28, for example the piston 28*b*, is at top dead center (i.e. the piston member 26 is at one or other extreme end of its stroke relative to the cylinder member 13) and the other piston 28*a* is at bottom dead center, the passage 48 establishes communication between the crank space 44 and the precompression chamber 36 on the other side of the portion 27 from the piston 28 that is at top dead center. Thus, as shown in FIGS. 1 and 2, the piston 28*b* is at T.D.C. and communication is established between the space 44 and the chamber 36*a* by way of the passage 48*a*. The working pistons 28*a* and 28*b* are hollow, defining respective interior spaces 37*a* and 37*b* which communicate with the precompression chambers 36*b* and 36*a* respectively by way of conduits 50*b* and 50*a* formed within the central piston portion 27. Radial passages 51*a* and 51*b* are formed in the walls of the piston 28*a* and 28*b* and communicate with the interior spaces 37*a* and 37*b* respectively. The radial passages 51 are normally closed by the wall of the cylinder, but are capable of registering with respective transfer passages 52*a* and 52*b*, formed in the members 16*a* and 16*b*, when the piston member 26 is in a predetermined position. As shown, the radial passage 51*a* registers with the transfer passage 52*a* when the piston 28*a* is at B.D.C., so that the precompression chamber 36*b*, which communicates with the space 37*a* by way of the conduit 50*b*, has minimum volume. The crowns of the working pistons 28*a* and 28*b* are recessed at 53*a* and 53*b* to uncover the transfer passages 52*a* and 52*b* when the respective pistons are at B.D.C.; thus, when the piston 28*a* is at B.D.C., fuel mixture which has been precompressed in the chamber 36*b* and forced by way of the conduit 50*b* into the space 37*a* is able to escape from the space 37*a* into the combustion chamber 32*a* by way of the passages 51*a* and 52*a*.

A circuit breaker cam ring 56 is arranged on the driven shaft 8 for controlling the spark plugs 23 disposed in the combustion chambers 32. The cam ring 56 breaks a circuit including the primary winding of an induction coil (not shown) whenever one of the pistons 28 is at or near T.D.C. This induces a high voltage in the secondary winding of the coil, and this is fed to an insulated stud 57. The tip of the stud is adjacent the position of the spark plugs 23 when their associated pistons are at T.D.C., and an arc is established between the stud 57 and the spark plug and accordingly the spark plug fires, causing the fuel in the combustion chamber 32 to ignite.

Burned gases escape from the combustion spaces 32*a* and 32*b* into the interior of the housing by way of exhaust openings 60*a* and 60*b* (FIG. 1) and mufflers 61*a* and 61*b*. The housing 6 has a cover plate 63 which supports the crankshaft 2. The plate 63 is formed with openings (not shown) for admitting air to the interior of the housing. Thus, when the rotor 4 rotates, cooling air is drawn into the housing for cooling the members 16 by means of the cooling fins mounted thereon and exhaust gases and heated air are expelled from the housing by way of a discharge conduit 58.

The housing 6 is formed at the side opposite the cover plate 63 with an air passage 3 which is connected by means of a tube 47 to the air intake of the engine at a position between the air filter and the carburetor. The air passage 3 communicates with an annular chamber which is defined between the driven shaft 8 and the housing 6 and is also bounded by two sealing rings 7. An annular bushing 5 is disposed in the chamber and is formed with a radial passage which registers with the outlet of the passage 3 and communicates at its inner end with an annular recess formed at the interior of the bushing 5 and having a semicircular cross-section. The shaft 8 is formed with radial bores 9 which establish communication between the annular recess and an axial bore 19 formed in the shaft 8. At its end remote from the radial bores 9, the axial bore 19 divides into two passages 30*a* and 30*b* which extend within the barrel 14 and the members 16 and open into the cylinders 18*a* and 18*b* respectively by way of radial bores 31*a* and 31*b*. The radial bores 31*a* and 31*b* are normally closed by the pistons 29*a* and 29*b*, but the radial bores 31*a* and 31*b* open into the pumping chambers 33*a* and 33*b* when the associated pistons 29*a* and 29*b* are at B.D.C. Thus, as illustrated in FIG. 1, the piston 29*a* is at B.D.C. and the radial bore 31*a* opens into the pumping chamber 33*a*.

Transfer conduits extend between the pumping chambers 33*a* and 33*b* and the combustion chambers 32*a* and 32*b* respectively. Each transfer conduit comprises a passage 34 which is formed within the member 16 and establishes communication between the pumping chamber 33 and a radial bore 35, formed in the piston 29, when the piston 29 is at T.D.C. The radial bore 35 communicates with an axial bore 37 which extends into the central portion 27 of the piston member and communicates, by way of a transverse bore 38, with a longitudinal bore 39 formed in the wall of the piston 28. The longitudinal bore 39 terminates in a radial bore 41, which communicates with the combustion chamber 32 by way of transfer passage 43, terminating in a nozzle 45, when the piston 28 is at TDC.

The rotary engine operates as follows: When the double-ended piston member 26 is in the position shown in FIGS. 1 and 2, fuel mixture will flow from the carburetor by way of the axial conduit 46 into the crank space 44, and will pass from space 44 by way of the passage 48*a* into the precompression space 36*a*. Simultaneously, fuel mixture of higher pressure in the conduit 50*b* and in the space 36*b* will flow into the combustion chamber 32*a* by way of the radial opening 51*a*, and the transfer passage 52*a*. The consumed or burned gases are simultaneously discharged by way of exhaust opening 60*a*. The inclination of the passage 52*a*, and the configuration of the crown of the piston 28*a*, with the recess 53*a*, ensures that fresh fuel mixture entering the combustion chamber 32*a* flows substantially vertically downwards, towards the head of the cylinder 17*a*, and thus purges the burned gases from the combustion chamber 32*a*.

While exhaust gases are being discharged from the combustion chamber 32*a* and fresh fuel mixture is entering the chamber 32*a* by way of the passage 52*a*, a regulated quantity of clean air which has passed through the air filter, the tube 47, air passage 3, the radial passage and annular recess in the bushing 5, radial bores 9, axial bore 19, passage 30*a* and radial bore 31*a* enters the pumping chamber 33*a*. The bushing 5, with its radial passage and annular recess, and the sealing rings 7 ensure a constant flow of air into the radial bores 9. The size of the radial bores 9 must be sufficient to convey the necessary quantity of air. Although several bores are shown, a single larger bore may be used instead.

The combustion chamber 32*b* is at this time under maximum compression, and the associated spark plug 23*b* receives ignition current from the stud 57 to ignite the fuel mixture and cause expansion thereof. The expanding fuel mixture in the combustion chamber 32*b* forces the piston member 26 downwardly, and the sliding motion of the carriage 40 in the sleeve 42 converts this compressive force or thrust into a torque about the axis of the main bearing journal pin 1 of the crankshaft 2. The rotor 4 starts to rotate counterclockwise as seen in FIG. 1. After a 90° rotation, the two combustion chambers 32*a* and 32*b* are of equal volume, and the carriage 40 is close to the (in FIG. 1) right-hand cylinder wall seen in FIG. 1, which wall is now on top. The pulse of the explosion in the combustion chamber 32*b* is sufficient to further rotate the rotor, and to bring the rotor into a position in which the combustion chamber 32*a* is now on top, so that the piston 28*a* is at T.D.C., and the fuel mixture present in the chamber 32*a* is also compressed, whereupon a new spark at the plug 23*a* will again trigger the above-described cycle.

When the combustion chamber 32*a* reaches maximum compression, so also does the pumping chamber 33*a* and at this instant communication is established between the pumping chamber 33*a* and the combustion chamber 32*a* by way of the transfer conduit, and accordingly fresh compressed air passes from the pumping chamber 33*a* into the combustion chamber 32*a*, in which the fuel mixture, ignited by the spark plug 23*a*, is burning. By injecting the fresh air, it is ensured that the fuel mixture burns completely thus ensuring maximum efficiency and minimum pollution.

During the downward motion of the piston member 26 (relative to the cylinder member 13) from the position shown in FIG. 1, the fuel mixture present in the precompression chamber 36*a* is compressed and passes through the conduit 50*a* into the space 37*b*, preparatory to entering the combustion chamber 32*a* by way of the passage 52*b* when the piston 28*b* is at B.D.C. Passage of the fuel mixture to the combustion chamber 32 by way of the space 37 has the desirable side effect of cooling the piston 28.

It will be appreciated that the pistons 28*a* and 28*b* are not coaxial with the central portion 27 of the piston member 26, but instead have their central axes displaced to opposite sides relative to the central axis of the portion 27. This not only facilitates accommodating the pistons 29*a* and 29*b* without unduly enlarging the central portion 27 of piston member 26 and the barrel 14 and cylinder members 16, but also increases the torque which can be produced by the engine. Thus, pressure on the heads of the pistons 28 tends to cause rotation of the piston member about the pin in the counterclockwise direction, as seen in FIG. 1.

The illustrated engine is designed to operate using an oil naphtha mixture for fuel, but it may readily be adapted to run on gasoline or diesel fuel.

It is to be understood that the invention is not limited to the specific construction shown and described, since it will be apparent to those skilled in the art that changes may be made without departing from the principles of the invention as defined in the appended claims.

We claim:

1. A rotary internal combustion engine comprising:

support means defining an axis of rotation and provided with static crankshaft means defining a crank axis which is offset from said axis of rotation;

a rotor assembly which is mounted by said support means to rotate about said axis of rotation and comprises a double-headed piston member having two primary pistons at opposite ends respectively of an intermediate portion of the piston member and also having two secondary pistons at opposite ends respectively of said intermediate portion, and a double-headed cylinder member defining two primary cylinders in which the two primary pistons are fitted respectively and also defining two secondary cylinders in which the two secondary pistons are fitted respectively, one of said members being connected to said crankshaft means to rotate about the crank axis defined thereby and the other being rotatable about said axis of rotation, whereby each piston reciprocates relative to the cylinder in which it is fitted as the rotor assembly rotates about said axis of rotation, the spaces in the primary cylinders which are bounded by the primary pistons fitted respectively therein constituting combustion chambers and the spaces in the secondary cylinders which are bounded by the secondary pistons filled respectively therein constituting pumping chambers;

means defining a fuel inlet;

first passage means establishing communication between the fuel inlet and the two combustion chambers, said first passage means including passages formed in the cylinder member and controlled by edge regions of the piston member;

means defining an air inlet; and second passage means establishing communication between the air inlet and the two pumping chambers and between the two pumping chambers and the combustion chambers respectively, said second passage means including passages formed in the cylinder member and controlled by edge regions of the piston member.

2. An engine as claimed in claim 1, wherein the cylinder member and the piston member define two precompression chambers in addition to the combustion chambers and the pumping chambers, and said first passage means establish communication between the fuel inlet and the two combustion chambers by way of the two precompression chambers respectively.

3. An engine as claimed in claim 2, wherein the intermediate portion of the piston member has at each of its opposite ends an end face from which a primary piston and a secondary piston project parallel to one another and to the central axis of said intermediate portion and spaced from one another in a direction perpendicular to said central axis, and said intermediate portion of the piston member is fitted to reciprocate in an intermediate cylinder defined by the cylinder member, and the two precompression spaces are defined by the cylinder member and the end faces respectively of said intermediate portion.

4. An engine as claimed in claim 3, wherein each of the primary pistons is hollow and has a peripheral wall, and is formed in its peripheral wall with a port which communicates with the hollow interior of the primary piston, and wherein the first passage means includes passages formed in the cylinder member and controlled by edge regions of the piston member to establish communication between the fuel inlet and each precompression space when the precompression space is of maximum volume and to interrupt such communication when the precompression space is of less than maximum volume, conduits formed in the piston member and establishing communication between each precompression space and the hollow interior of the piston at the opposite end of the intermediate portion from the precompression space, and transfer passages formed in the walls of the primary cylinders and controlled by edge regions of the primary pistons fitted in the primary cylinders respectively to establish communication between the port of each primary piston and the combustion chamber bounded by the primary piston when the combustion chamber is of maximum volume and to interrupt such communication when the combustion chamber is of less than maximum volume.

5. An engine as claimed in claim 3, wherein the central axis of the intermediate portion of the piston member is disposed between the central axes of the two primary pistons.

6. An engine as claimed in claim 1, further comprising a sleeve which is fitted in said one member, and a carriage which is mounted in said sleeve to be slidable therewithin in directions perpendicular to the longitudinal axis of said one member, and wherein said crankshaft means include a crank pin defining said crank axis, said pin being received in said carriage.

7. An engine as claimed in claim 1, further comprising exhaust passages which extend to the exterior from the combustion chambers, each exhaust passage being controlled by an edge of the piston reciprocating in the associated combustion chamber to be open when the combustion chamber has its maximum volume.

8. An engine as claimed in claim 1, wherein the crankshaft means include a main bearing journal pin which is coaxial with said axis of rotation, a crank pin defining said crank axis and a crank web connecting the pins together, the crank web extending within a space bounded by said one member and communicating with a conduit formed in said main bearing journal pin for feeding fuel to said space.

9. An engine as claimed in claim 2, wherein each precompression space is at the opposite end with respect to the intermediate portion of the piston member from the combustion chamber with which it communicates by way of said first passage means.

10. An engine as claimed in claim 1, wherein the central axes of the two primary pistons are parallel to one another and are spaced apart from one another with the axis about which the piston member rotates being disposed in the space between said central axes.

11. An engine as claimed in claim 1, wherein the central axes of the two primary pistons are parallel to one another and are spaced apart from one another, and the central axis of the intermediate portion of the piston member is parallel to the central axes of the primary pistons and is disposed therebetween, equidistant therefrom.

* * * * *